United States Patent [19]

Nichols

[11] Patent Number: 4,539,962

[45] Date of Patent: Sep. 10, 1985

[54] FUEL INJECTION SYSTEM

[75] Inventor: Gary A. Nichols, Rochester, N.Y.

[73] Assignee: General Motors Corporation, Detroit, Mich.

[21] Appl. No.: 672,996

[22] Filed: Nov. 19, 1984

[51] Int. Cl.[3] ..... F02M 51/02

[52] U.S. Cl. ..... 123/470; 123/497; 239/124; 239/132.5

[58] Field of Search ..... 123/470, 478, 472, 497, 123/498, 499, 446, 514; 239/124, 132.5

[56] References Cited

U.S. PATENT DOCUMENTS

| | | | |
|---|---|---|---|
| 3,026,928 | 3/1962 | Phillips et al. | 123/495 |
| 3,788,287 | 1/1974 | Falen et al. | 123/470 |
| 4,235,375 | 11/1980 | Melotti | 123/470 |
| 4,503,826 | 3/1985 | Kessler et al. | 123/470 |

*Primary Examiner*—Magdalen Y. C. Moy

*Attorney, Agent, or Firm*—C. K. Veenstra

[57] ABSTRACT

A fuel injection system has an electronic module mounted directly on a fuel body portion of the fuel injection system for cooling by fuel flow through the fuel body. The electronic module energizes a fuel pump to circulate fuel through the fuel body, even when the engine is not operating, if the temperature within the module exceeds a selected level.

2 Claims, 1 Drawing Figure

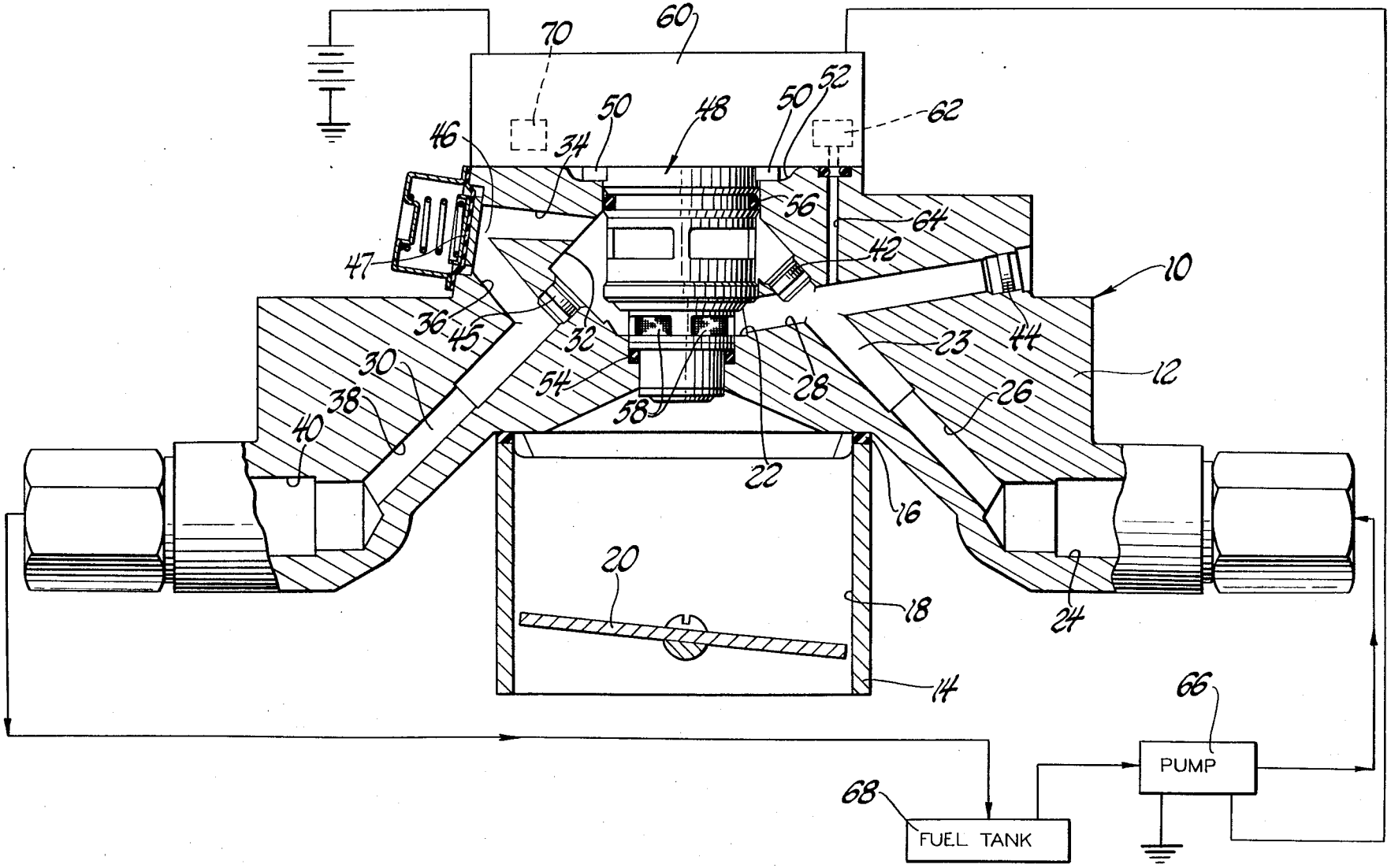
PUMP
FUEL TANK

FUEL INJECTION SYSTEM

TECHNICAL FIELD

This invention relates to apparatus having an electronically operated injector for delivering fuel to an engine induction passage.

BACKGROUND

In a fuel injection system having an electronic module which operates an injector to deliver fuel to an engine induction passage, provision must be made for cooling at least some of the electronic components within the module to prevent excessive temperatures within the module. As proposed in U.S. patent application Ser. No. 256,563 filed Apr. 22, 1981 in the names of D. R. Kessler, D. W. Beiswenger and A. J. Makusij and now Pat. No. 4,503,826, the electronic module may be mounted in maximum heat transfer relation to the fuel injection assembly adjacent a fuel passage in the assembly. Fuel circulating through the passage absorbs and carries away heat conducted from the module to prevent excessive temperatures within the module.

While that proposal is effective for preventing excessive temperatures within the electronic module during operation of the engine, it has not been effective for preventing excessive temperatures within the module during the hot soak period which occurs immediately after the engine has been shut off.

SUMMARY OF THE INVENTION

This invention provides an improved fuel injection system in which an electronic module is mounted directly on a fuel body portion of the fuel injection system for cooling by fuel flow through the fuel body both when the engine is operating and when the engine is shut off.

In a fuel injection system according to this invention, means are provided for energizing a fuel pump to circulate fuel through the fuel body whenever the temperature within the electronic module increases above a selected level, even though the engine may not be operating. The fuel absorbs and carries away heat conducted from the module and is circulated through the fuel body to the extent necessary to prevent excessive temperatures within the module.

The details as well as other features and advantages of a preferred embodiment of this invention are set forth in the remainder of the specification and are shown in the accompanying drawing.

SUMMARY OF THE DRAWING

The sole FIGURE of the drawing is a schematic view of a throttle body fuel injection system employing a preferred embodiment of this invention.

THE PREFERRED EMBODIMENT

Referring to the drawing, a throttle body fuel injection assembly 10 includes a heat conductive aluminum fuel body 12 mounted on a throttle body 14 and separated therefrom by a gasket 16. Throttle body 14 defines a portion of an engine induction passage 18 having an air inlet (not shown) around the sides of fuel body 12 and having a throttle 20 for controlling flow through induction passage 18 in the usual manner.

Fuel body 12 includes an injector cavity 22 which receives fuel from an inlet passage 23 formed by bores 24, 26 and 28 and which discharges excess fuel through an outlet passage 30 formed by bores 32, 34, 36, 38 and 40. A plug 42 at the end of bore 26 directs fuel from bore 26 through bore 28 into the lower portion of injector cavity 22, and a plug 44 closes the outer end of bore 28. A plug 45 between bores 32 and 38 directs fuel from bore 32 through bore 34 to an accumulator chamber 46 closed at one side by a spring biased diaphragm 47. From accumulator chamber 46, fuel flows through bore 36 to bores 38 and 40.

An electromagnetic fuel injector 48 is disposed in injector cavity 22 and has flanges 50 supported in a recess 52 at the top of fuel body 12. An O-ring 54 provides a seal between injector 48 and fuel body 12 below injector cavity 22, and an O-ring 56 provides a seal between injector 48 and fuel body 12 above injector cavity 22. Injector 48 receives fuel from injector cavity 22 through screened openings 58 and, when operated by an electronic module 60, delivers a timed pulse of fuel in a hollow conical spray pattern for mixture with the air which flows through induction passage 18.

Electronic module 60 operates injector 48 at regular intervals and controls fuel flow by varying the duration of the fuel delivery pulses: when increased fuel delivery is required, module 60 increases the duration of the fuel delivery pulses, and when decreased fuel delivery is required, module 60 decreases the duration of the fuel delivery pulses.

It is recognized, of course, that variations in the pressure of the fuel in injector cavity 22 also affect fuel delivery by the injectors, and a pressure regulator is often provided to maintain a constant fuel pressure in cavity 22. In the embodiment of this invention illustrated here, however, electronic module 60 has a sensor 62 connected through a bore 64 to measure the fuel pressure in bore 28 and thus in cavity 22. Module 60 adjusts the duration of the fuel delivery pulses in response to variations in the fuel pressure measured by sensor 62 so that the required fuel is delivered irrespective of variations in the fuel pressure.

In the embodiment of this invention illustrated here, moreover, module 60 also controls a fuel pump 66 which circulates fuel from a fuel tank 68 through inlet passage 23, injector cavity 22, and outlet passage 30 and back to tank 68. Module 60 may control fuel pump 66 to maintain a constant fuel pressure in bore 28 and cavity 22. Preferably, however, module 60 controls fuel pump 66 to increase the fuel pressure in bore 28 and cavity 22 when increased fuel delivery is required and to decrease the fuel pressure in bore 28 and cavity 22 when decreased fuel delivery is required. When the fuel pressure is increased, the duration of the fuel delivery pulse required to deliver a particular amount of fuel is reduced, and when the fuel pressure is decreased, the duration of the fuel delivery pulse required to deliver a particular amount of fuel is decreased. Thus by varying the fuel pressure in injector cavity 22, module 60 maintains the duration of the fuel delivery pulses within a narrower range than is possible when the fuel pressure is held constant.

Electronic module 60 is mounted in maximum heat transfer relation to fuel body 12 adjacent inlet and outlet passages 23 and 30. During engine operation, fuel body 12 conducts heat from module 60 and fuel circulating through the passages absorbs and carries the heat away from module 60 to prevent excessive temperatures within the module.

Module 60 also includes a temperature sensor 70 which measures the temperature within module 60. Even when the engine is not operating, module 60 energizes fuel pump 66 to circulate fuel through fuel body 12 in response to an increase in the temperature measured by sensor 70 above a selected level. The circulating fuel absorbs and carries away heat conducted through fuel body 12 from module 60. Module 60 energizes pump 66 to circulate fuel through fuel body 12 to the extent necessary to prevent excessive temperatures within the module.

It will be appreciated, therefore, that this invention provides an improved fuel injection system in which an electronic module mounted directly on a fuel body portion of the fuel injection system is cooled by fuel flow through the fuel body both when the engine is operating and when the engine is shut off.

The embodiments of the invention in which an exclusive property or privilege is claimed are defined as follows:

1. In a fuel injection system having a fuel passage, a fuel pump energizable for circulating fuel through said passage, an injector operable for delivering fuel from said passage, and an electronic module adapted to operate said injector, and wherein a portion of said passage is formed in a body of heat conductive material and said module is mounted in maximum heat transfer relation to said body for conducting heat from said module to said body, the improvement comprising means for energizing said fuel pump in response to an increase in temperature in said module above a selected level to circulate fuel through said body whereby heat conducted from said module to said body is absorbed and directed away from said body and said module to thereby prevent excessive temperatures in said module.

2. The method of operating a fuel injection system having a fuel passage, a fuel pump energizable for circulating fuel through said passage, an injector operable for delivering fuel from said passage, and an electronic module adapted to operate said injector, and wherein a portion of said passage is formed in a body of heat conductive material and said module is mounted in maximum heat transfer relation to said body for conducting heat from said module to said body, said method comprising the step of energizing said fuel pump in response to an increase in temperature in said module above a selected level to circulate fuel through said body whereby heat conducted from said module to said body is absorbed and directed away from said body and said module to thereby prevent excessive temperatures in said module.

* * * * *